US006202250B1

(12) United States Patent
Kenmochi et al.

(10) Patent No.: US 6,202,250 B1
(45) Date of Patent: Mar. 20, 2001

(54) WIPING SHEET

(75) Inventors: Yasuhiko Kenmochi; Hiroki Ishikawa, both of Kagawa-ken (JP)

(73) Assignee: Uni-Charm Corporation (JP)

( * ) Notice: Subject to any disclaimer, the term of this patent is extended or adjusted under 35 U.S.C. 154(b) by 0 days.

(21) Appl. No.: 09/233,341

(22) Filed: Jan. 19, 1999

(51) Int. Cl.[7] ..... A47L 13/20

(52) U.S. Cl. ..... 15/231; 15/209.1; 15/228; 428/81; 428/84; 428/131; 428/132; 428/134; 428/136; 428/192

(58) Field of Search ..... 15/220.1, 228, 15/231, 232, 208, 209.1, 210.1; 428/81, 84, 131, 132, 134, 136, 192

(56) References Cited

U.S. PATENT DOCUMENTS

| | | | | |
|---|---|---|---|---|
| T990,006 | * | 1/1980 | Williams | 428/134 |
| 1,167,603 | * | 1/1916 | Swift | 428/132 |
| 1,384,515 | * | 7/1921 | Conradson | 15/208 |
| 2,306,944 | * | 12/1942 | Gray | 15/231 |
| 3,655,501 | * | 4/1972 | Tesch | 428/136 |
| 3,877,103 | * | 4/1975 | Nash | 15/231 |
| 4,225,998 | * | 10/1980 | Thielen | 15/231 |
| 4,303,714 | * | 12/1981 | Mercer | 428/134 |
| 4,323,605 | * | 4/1982 | Rush | 428/134 |
| 4,469,734 | * | 9/1984 | Minto | 428/134 |
| 4,481,242 | * | 11/1984 | Fletcher | 428/134 |
| 4,852,210 | * | 8/1989 | Krajicek | 15/228 |
| 5,536,555 | * | 7/1996 | Zelazoski | 428/136 |
| 5,744,212 | * | 4/1998 | Meeks | 428/134 |
| 6,058,552 | * | 5/2000 | Hanan | 15/231 |

FOREIGN PATENT DOCUMENTS

| | | | | |
|---|---|---|---|---|
| 1915523 | * | 10/1969 | (DE) | 428/136 |
| 0550539 | * | 3/1993 | (JP) | 428/134 |

* cited by examiner

*Primary Examiner*—Randall E. Chin
(74) *Attorney, Agent, or Firm*—Baker & Daniels

(57) ABSTRACT

A rectangular wiping sheet adapted to be attached to a plate-like head of a cleaner device used to clean a surface of house floor or the similar surfaces is provided adjacent a pair of sides thereof extending in parallel to each other with a plurality of slits extending through a thickness of the sheet, and each of these slits has a length of 5~30 mm as measured in a direction along the parallel sides.

3 Claims, 2 Drawing Sheets

FIG.I

WIPING SHEET

BACKGROUND OF THE INVENTION

This invention relates generally to a wiping sheet adapted to be attached to a device used to clean house floors or walls.

As a convenient measure to clean a surface of house floor or the similar surfaces, it is well known to use a wiping sheet, for example, made of a nonwoven fabric adapted to be detachably attached to a cleaner device comprising a rectangular plate-like head and a stick pivotally mounted on a top surface of the plate-like head. The wiping sheet is put against a bottom surface of the plate-like head and front and rear or right and left marginal regions of the wiping sheet are folded back onto the top surface of the plate-like head so as to be fastened by clip means or the other fastening means provided on the top surface of the plate-like head.

The known wiping sheet has been available in various types, for example, those which are relatively thin, relatively thick, of relatively low rigidity and relatively high rigidity. The cleaner device, on the other hand, has generally been designed so that any one of these different sheets can be attached thereto. However, the means to fasten the wiping sheet has usually been of simple construction because it is essential to such cleaner device that the wiping sheet can be easily attached to the cleaner device. In consequence, it has been sometimes difficult for such conventional cleaner device to attach a wiping sheet of extremely high rigidity to the cleaner device even if it is possible to attach a relatively soft wiping sheet of relatively low rigidity to the cleaner device. Furthermore, the conventional cleaner devices has sometimes had a problem that a wiping sheet impregnated with plenty of oily agent is apt to slip and to be unintentionally detached from the cleaner device even after the wiping sheet has been held by clip means.

SUMMARY OF THE INVENTION

In view of the problems as have been described above, it is an object of the invention to provide an improved wiping sheet well-adapted for the various existing cleaner device.

According to the invention, there is provided a rectangular wiping sheet adapted to be attached to a rectangular plate-like head which is, in turn, combined with a stick mounted on a top surface of the plate-like head to form a cleaner device used to clean a surface of floor or the similar surfaces, wherein the wiping sheet is provided adjacent a pair of sides thereof extending in parallel to each other with a plurality of slits extending through a thickness of the wiping sheet and each of the slits has a length of 5~30 mm as measured in a direction along the pair of sides.

In a further embodiment of the invention, the slits are linearly formed.

In a further embodiment of the invention, the slits are formed in a generally V-shape.

In a further embodiment of the invention, the wiping sheet is made of a nonwoven fabric.

With the inventive wiping sheet formed with the slits, marginal regions of the wiping sheet can be easily and reliably head by crip means provided on a top surface of the plate-like head even when the wiping sheet is of a relatively high rigidity, since the marginal regions of the wiping sheet defined by the slits have their rigidity appropriately lowered. When the cleaner device employs anchoring projections instead of the clip means, these projections may be inserted into the slits to hold the wiping sheet.

Other and further objects, features and advantages of the invention will appear more fully from the following description.

DESCRIPTION OF THE PREFERRED EMBODIMENT

Figure 1:
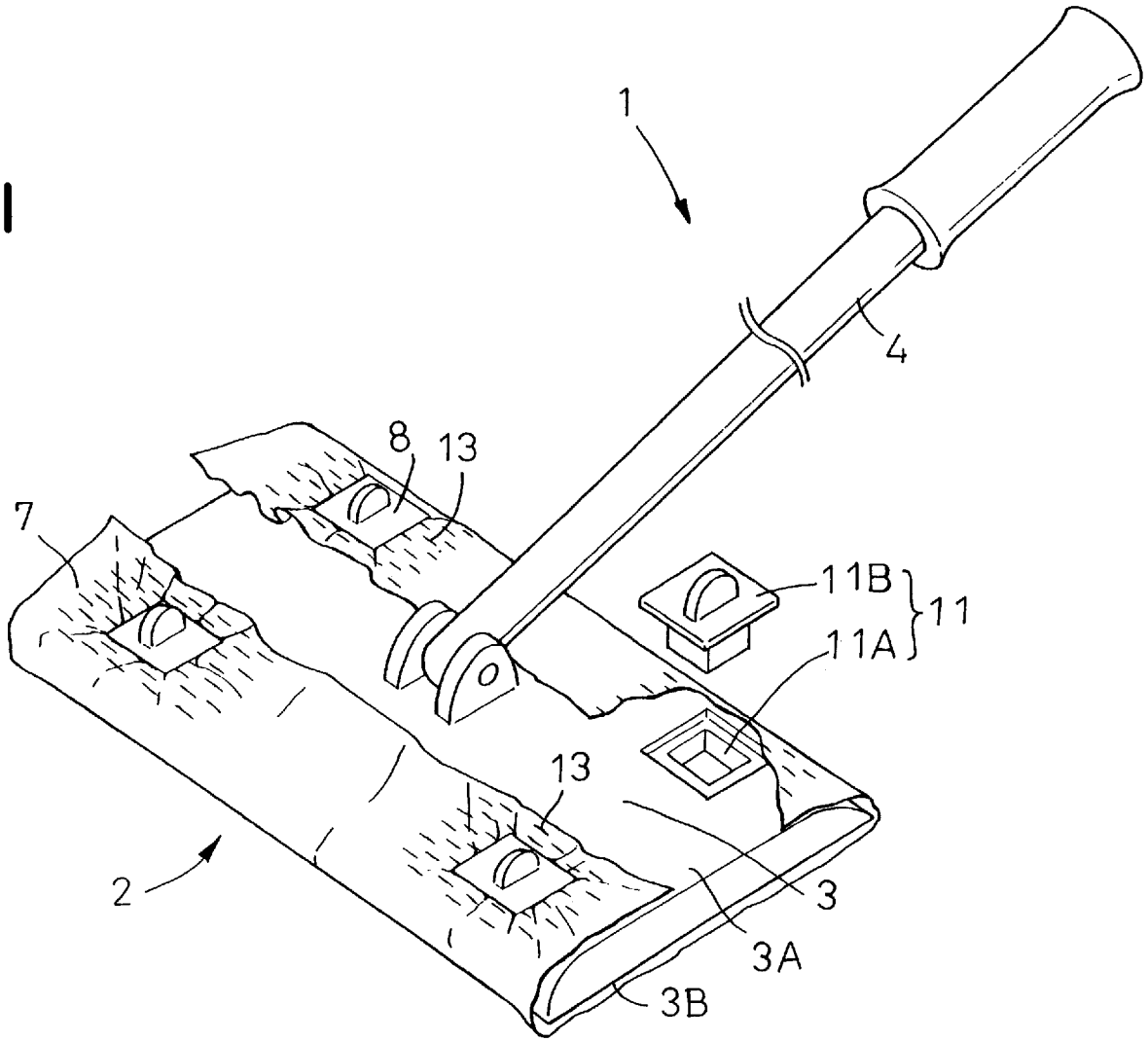
FIG. 1 is a perspective view of a cleaner device with a wiping sheet according to the invention attached thereto.

FIG. 1 is a perspective view of a cleaner device 1 with a wiping sheet 2 attached thereto as the wiping sheet being partially broken away. The cleaner device 1 comprises a rectangular plate-like head 3 and a stick 4 pivotally mounted on a top surface 3A of the plate-like head 3 at the middle thereof. The wiping sheet 2 is put against a bottom surface 3B of the plate-like head 3 and folded along front and rear marginal regions 7, 8 onto the top surface 3A of the plate-like head 3 so as to be fastened by clip means 11 provided on the top surface 3A. Each of the clip means 11 comprises a rectangular recess 11A formed in the top surface 3A and a plug-in knob 11B so that the wiping sheet 2 can be held between the plug-in knob 11B and the recess 11A. These clip means 11 are provided at four corners of the top surface 3A, respectively.

Figure 2:
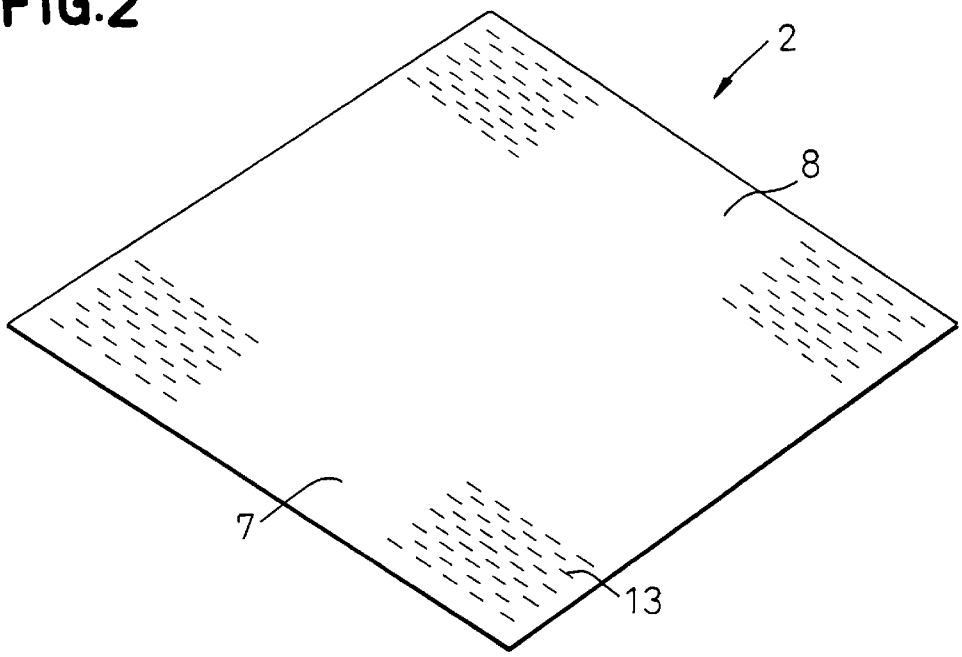
FIG. 2 is a perspective view of an embodiment of the wiping sheet according to the invention.

FIG. 2 is a perspective view of the wiping sheet 2. The wiping sheet 2 may be made of various materials such as a nonwoven fabric, a woven fabric, a laminated paper or plastic film, which is rectangular in its plane figure and formed in parallel to its front and rear edges with a plurality lines of slits 13 each extending through a thickness of the wiping sheet 2. The wiping sheet 2 shown by FIG. 2 is formed at each corner with a group of such slits 13 so that the associated recess 11A and a region around it may be covered by this group of slits 13 when the front and rear marginal regions 7, 8 are folded back onto the top surface 3A.

With the wiping sheet 2 formed with the slits 13, the marginal regions 7, 8 can be easily and reliably held by the clip means 11 even when the wiping sheet 2 is of a relatively high rigidity, since the marginal regions of the wiping sheet 2 defined by the slits 13 have their rigidity appropriately lowered. When the cleaner device 1 employs anchoring projections instead of the clip means 11, these projections may be inserted into the respective slits 13 to hold the wiping sheet 2.

Figure 3:
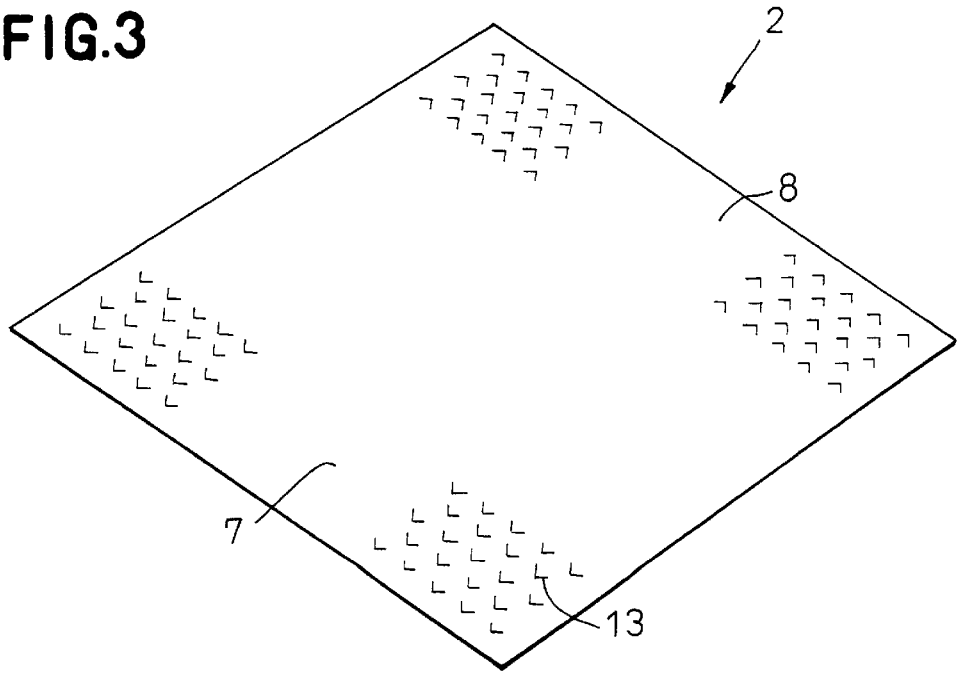
FIG. 3 is a view similar to FIG. 2 but showing an alternative embodiment of the wiping sheet according to the invention.

FIG. 3 is a perspective view showing an alternative embodiment of the wiping sheet 2 which differs from the wiping sheet 2 shown by FIG. 2 in that the linear slits 13 adopted in the previous embodiment are replaced by generally V-shaped slits 13. Each V-shaped slit 13 has a width of 5~30 mm and a height of 2~20 mm. While the shape of each slit 13 is selective depending on the type as well as the size of the cleaner device 1, it is preferable that each slit 13 has a length of 5~30 mm along the front and rear marginal regions 7, 8 of the wiping sheet 2 and is opened as the front and rear marginal regions 7, 8 are pulled in a direction orthogonal to the marginal regions 7, 8. The slits 13 adapted to be opened in this manner facilitate the anchoring projections on the top surface 3A of the plate-like head 3 to be inserted into the respective slits 13. The wiping sheet 2 of the invention is not limited to the flat sheet which is typical in the case of nonwoven fabric, and may have a plurality of long piles contributing to an improvement of wiping effect for dust and dirt.

Having described the invention as related to the embodiment shown in the accompanying drawings, it is our intention that the invention be not limited by any of the details of description, unless otherwise specified, but rather be construed broadly within its spirit and scope as set out in the accompanying claims.

What is claimed is:

1. The combination of a cleaner device, clip means, and a wiping sheet securable to the cleaner by the clip means the cleaner device comprising a rectangular plate head, the clip means being configured for securing the wiping sheet at each corner of a top surface of the plate head, and the wiping sheet comprising a rectangular sheet having corners and discrete groups comprising a plurality of slits at each of the corners which cooperate with the clip means so that the clip means can displace or pass through and engage the discrete groups of slits to thereby secure the wiping sheet to the plate head.

2. The combination of claim 1, wherein said wiping sheet is made of a nonwoven fabric.

3. The combination of claim 1, wherein the cleaner device further includes a handle.

* * * * *